United States Patent [19]

Hartley

[11] Patent Number: 4,717,185

[45] Date of Patent: Jan. 5, 1988

[54] SECURITY STRIKER PLATE

[76] Inventor: Richard A. Hartley, 25834 Continental Cir., Taylor, Mich. 48180

[21] Appl. No.: 890,253

[22] Filed: Jul. 28, 1986

[51] Int. Cl.[4] ..... E05C 21/02

[52] U.S. Cl. ..... 292/340; 292/346; 52/DIG. 6

[58] Field of Search ..... 292/340, 346, 1; 52/DIG. 6

[56] References Cited

U.S. PATENT DOCUMENTS

| | | | |
|---|---|---|---|
| 1,245,049 | 10/1917 | Silverstein . | |
| 1,844,459 | 2/1929 | Brandon . | |
| 3,764,173 | 10/1973 | Griffith | 292/346 |
| 3,815,945 | 6/1974 | Lamphere | 292/340 |
| 3,858,917 | 1/1975 | Nahon | 292/57 |
| 3,888,530 | 6/1975 | Fabrici | 292/346 |
| 4,021,880 | 5/1977 | Murphy | 292/340 |
| 4,074,484 | 2/1978 | Queren | 292/346 |
| 4,174,862 | 11/1979 | Shane | 292/346 |
| 4,195,870 | 4/1980 | Percoco | 292/340 |
| 4,383,709 | 5/1983 | Ronan | 292/346 |
| 4,474,394 | 10/1984 | Crepinsek | 292/340 |

FOREIGN PATENT DOCUMENTS

| | | | |
|---|---|---|---|
| 573858 | 4/1959 | Canada | 52/DIG. 6 |

OTHER PUBLICATIONS

Publication entitled, "How to Protect Your Home", Consumer Reports, Oct. 1984, pp. 554–563.

*Primary Examiner*—Richard E. Moore

*Attorney, Agent, or Firm*—Cullen, Sloman, Cantor, Grauer, Scott & Rutherford

[57] ABSTRACT

A security striker plate for a lock assembly upon a door hinged within a door jamb including a peripheral door stop and interior framing studs comprises a unit body of U-shape including spaced inner and outer mount plates snugly positioned upon the studs and apertured for nailing thereto. A right angular apertured strike plate extends from the inner mount plate, faces the door when closed and terminates in a right angular door stop lip nested within the door stop and door jamb. An anchor plate extends from the lip underlies the door jamb, is retained thereby and is connected to the outer mount plate.

10 Claims, 7 Drawing Figures

SECURITY STRIKER PLATE

FIELD OF THE INVENTION

The present invention relates to an improvement in strike plate construction which is attached to the framing members of the exterior wall in lieu of the door frame to deter unauthorized entry.

RELATED PATENT APPLICATION

Copending application Ser. No. 866,748, filed May 27, 1986, entitled: "Security Striker Plate".

BACKGROUND OF THE INVENTION

The striker plates in typical homes normallly do not pose a real deterent to unauthorized entry. Unauthorized entry can be achieved by kicking the door and splitting the door jamb or dislodging the striker plate or prying the door and door jamb apart to disengage the door latch from the striker plate or cutting the door latch with loose fitting doors and jambs or those that can be pried apart.

While many weaknesses in door locks pertain to the nature of the locking member upon the door and the ease with which the lock can be picked, the existing problem relates to the inherent weakness of current door frames by which using a jimmy or other crow bar or tool, the door frame can be pried or separated from the door sufficiently to disconnect the bolt latch from the jamb or rail to permit unauthorized entry.

Often the conventional strike plate provides very little protection against access to the strike plate with a tool or with a saw which may sever the deadbolt or latch bolt or will retract or sufficiently bend the anchoring screws which are not of sufficient length or anchorage to resist much exterior force. Heretofore in door frame constructions, the frame itself is inherently weak, particularly so at the location of the strike plate rendering the door vulnerable to exterior assault and tampering to obtain illegal access by forced opening of the door.

Standard striker plates are of such construction as to provide mechanical access to the interior of the latching mechanism and to the strike plate such as will permit the application of a prying tool thereinto or a crow bar or a saw, or other tool such as will destroy the door locks or at least render them ineffective.

Various means have been employed to try to protect door frames and door lock sets and striker plates to be less vulnerable to intruders.

THE PRIOR ART

Strike plates are shown in one or more of the following patents:

| Patent No. | Patentee | Date |
|---|---|---|
| 1,245,049 | M. L. Silverstein | 10/30/17 |
| 1,844,459 | J. R. Brandon | 2/9/32 |
| 3,815,945 | Lamphere | 6/11/74 |
| 4,021,880 | Murphy | 5/10/77 |
| 4,383,709 | Ronan | 5/17/83 |
| 4,474,394 | Crepinsek | 10/2/84 |

SUMMARY OF THE INVENTION

It is an object of the present invention to provide an improved security striker plate assembly for a door frame which is attached to framing members of an exterior wall adjacent the door jamb which prevents the door from being kicked in and otherwise armors and protectively encloses vital parts of the locking mechanism for the door.

An important feature is to provide a security striker plate for a door which is mounted upon the interior of the door jamb and wherein a series of long fastener nails are employed which project through inner and outer mount plates of the unit striker plate and into interior 2" by 4" studs for firm and effective anchorage of the striker plate to the framing members of the exterior wall.

An important feature is to provide an improved security striker plate for the locking means upon a door which is hinged within a door jamb including an upright rail, a peripheral door stop and interior framing studs such that when the door stop lip of the unit striker plate is mounted upon a cut away portion of the door stop, the striker plate is anchored and affixed by long nails which extend directly into the interior studs for a positive anchoring and securing of the security striker plate in position.

It is another feature to provide an improved security striker plate which reinforces the door jamb and rail, particularly at the locking assembly, such as a latch bolt and deadbolt mounted upon the door such as will protect the door from tampering and particularly destruction of the locks or prying of the frame away from the door to disengage the deadbolt or latch bolt from the striker plate.

It is another feature to provide in conjunction with the security striker plate opposed inner and outer mount plates adapted to be inset and bear directly against the interior 2×4" studs and secured thereto by a series of long nails which extend therethrough and into the studs. The inner mount plate terminates in a right angular apertured strike plate which faces the door when closed, which terminates in a right angular door stop lip which is supported upon the door jamb.

A further feature includes the right angular door stop lip which is in registry with and reinforces the existing door stop adapted to receive the door when closed from the inside of the building. A right angular anchor plate projects from the door stop lip and registers with an interior portion of the door jamb and extends to and is connected with the outer mount plate.

An important feature includes the formation as a part of the striker plate rearwardly of the door stop lip a fin which extends rearwardly of the strike plate to the anchor plate and is protectively enclosed by the door jamb.

As another feature, the present striker plate is adapted for new buiding construction wherein the mount plates overlie and receive the 2×4" studs and are nailed thereto, with the anchor plate overlying and enclosed by the door jamb and the inner mount plate enclosed by a dry wall which extends to the strike plate.

These and other objects and features will be seen from the following specification and claims in conjunction with the appended drawings.

THE DRAWINGS

It will be understood that the above drawings illustrate merely a preferred embodiment of the invention and that other embodiments are contemplated within the scope of the claims hereafter set forth.

DETAILED DESCRIPTION OF AN EMBODIMENT OF THE INVENTION

The present security striker plate 11 in the illustrative embodiment is formed of extruded aluminum, though not limited thereto.

Figure 1:
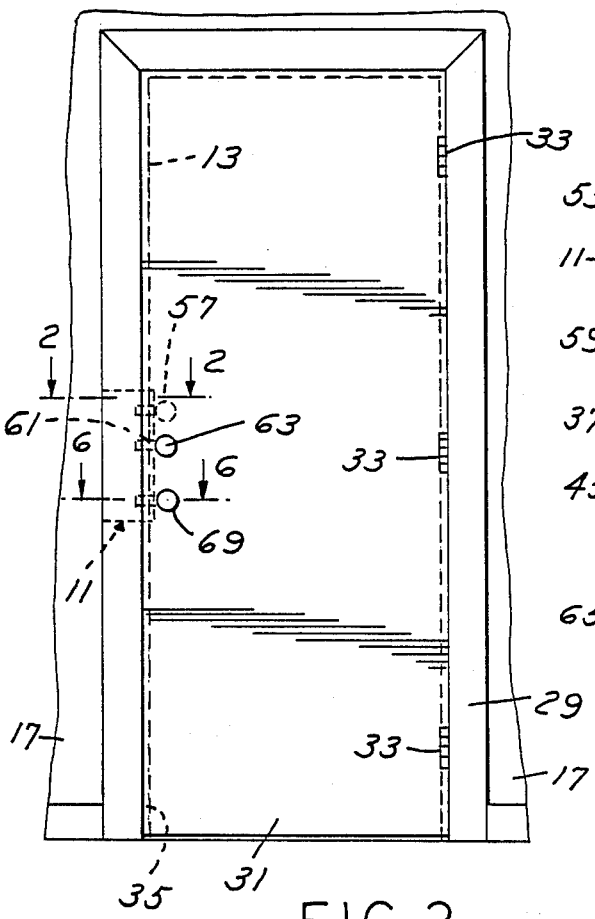
FIG. 1 is a fragmentary interior elevational view of the present security striker plate as mounted within and upon the framing member of an exterior wall with a door hinged upon and within a door jamb.
Figure 3:
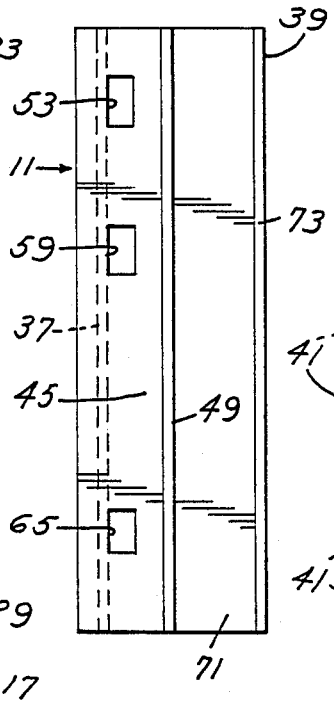
FIG. 3 is a front elevational view of the striker plate shown in FIG. 5, on a reduced scale.
Figure 5:
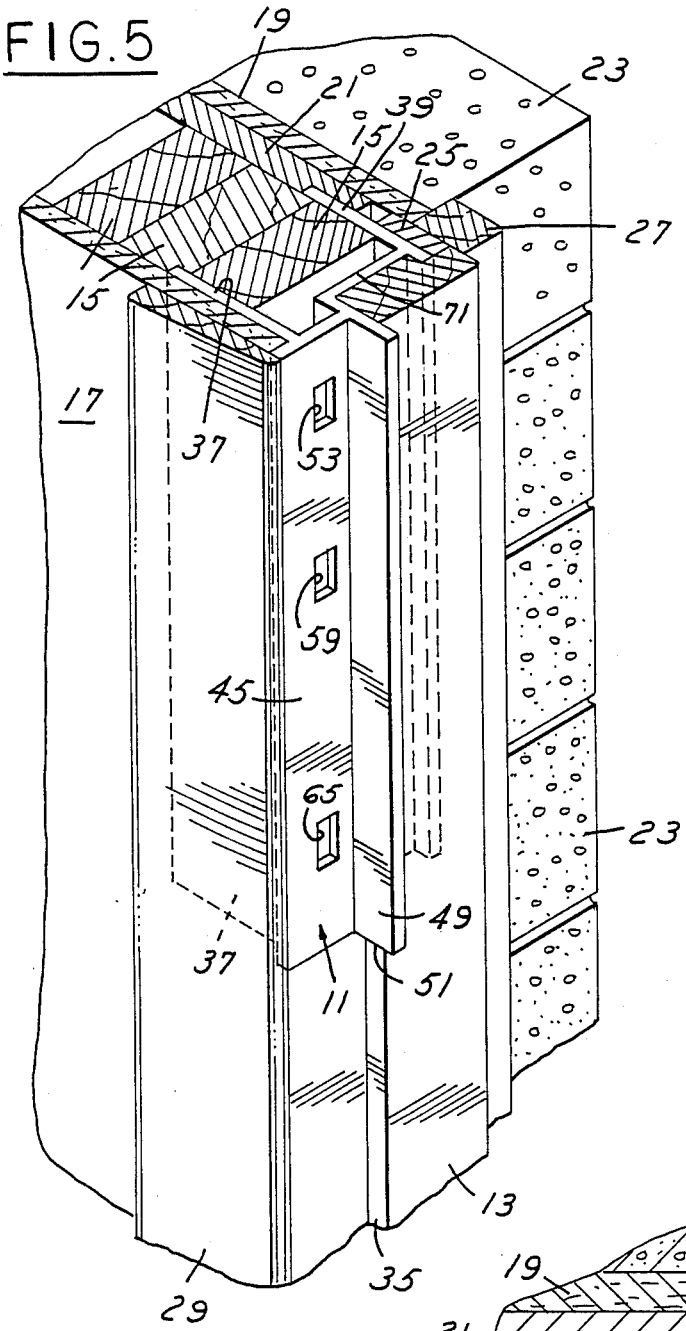
FIG. 5 is a front perspective view of the security striker plate as assembled upon the framing member of an exterior wall.

The present security striker plate is positioned within an exterior door jamb 13, FIGS. 1 and 5, which includes interior framing studs 15 in the illustrative embodiment 2×4" studs of which three are shown arranged side by side.

Figure 2:
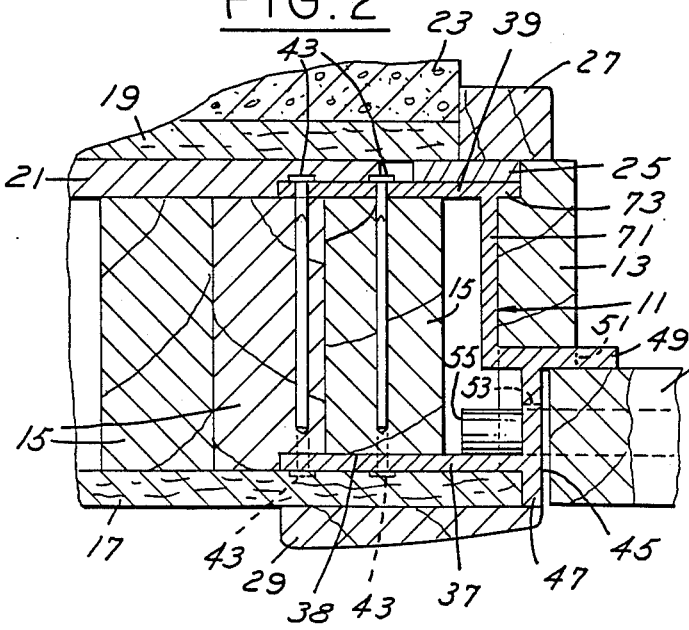
FIG. 2 is a fragmentary plan section taken in the direction of arrows 2—2 of FIG. 1, on an increased scale.
Figure 7:
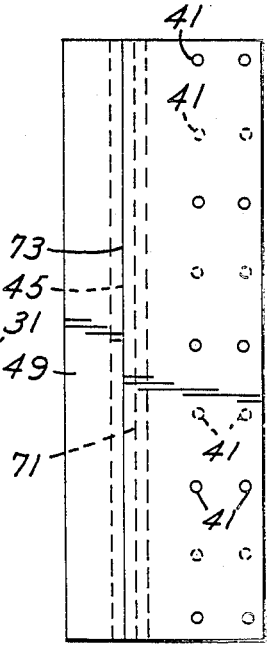
FIG. 7 is a right side elevational view of the striker plate shown in FIG. 3.

The present security striker plate 11 is mounted over and secured to the studs 15 and is enclosed by the inner dry wall 17, FIGS. 2 and 5, and the upright outer dry wall 19 with intermediate layer of insulation 21, sometimes referred to as Celotax (tm), all fragmentarily shown.

In the exterior wall construction, there is shown at 23 a brick or other veneer construction which may be stone. Interior upright nailing strip 25 of rectangular cross-section as in FIG. 6 extends upon the interior of and at right angles to door jamb 13 and is suitably secured thereto. Upright formed wood molding 27 for the bricks 23 or other veneer registers with the outer edge of door jamb 13, overlies and is secured to nailing strip 25 by nails or other fasteners. Surrounding the exterior door jamb 13, and upon the interior of illustrative building is the mitered casing 29 arranged outwardly of the conventional door 31 which is hinged within the door jamb 13 as by hinges 33.

Figure 6:
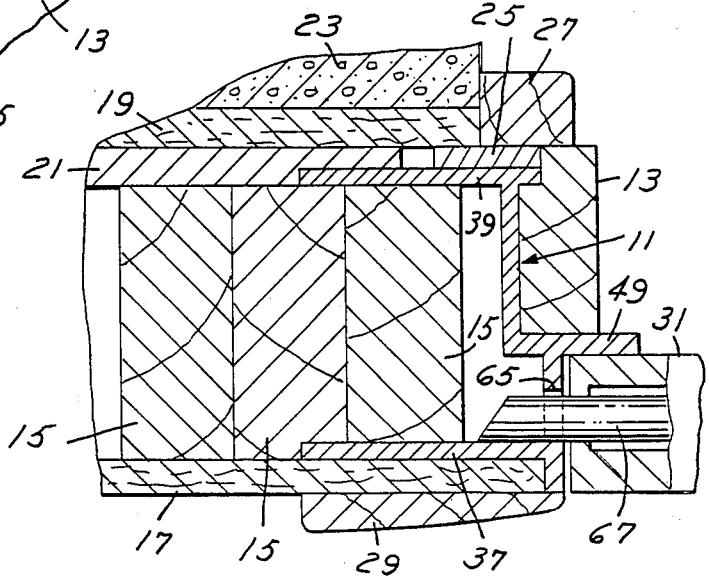
FIG. 6 is a plan section taken in the direction of arrows 6—6 of FIG. 1, on an increased scale.

Conventional door jamb 13 includes the upright rail which is a part thereof and the continuous peripheral door stop 35, FIG. 1, with which the door registers when fully closed, as in FIGS. 2 and 6.

The present security striker plate has a unit body which may be extruded of aluminum, for illustration, and includes upright inner mount plate 37 and spaced therefrom outer mount plate 39. Portions of the upright studs 15 are cut away or notched as at 38, FIG. 2, adapted to cooperatively receive portions of inner mount plate 37 for locating and positioning and anchoring said mount plate against inward movement relative to said studs.

Figure 4:
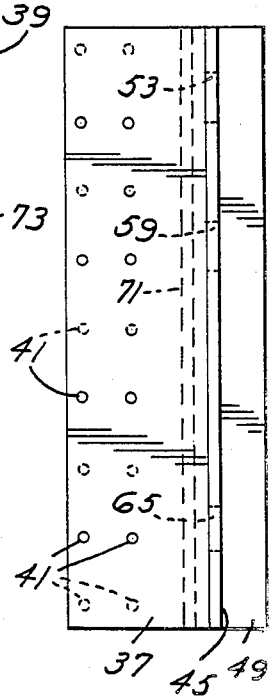
FIG. 4 is a left side elevational view thereof.

Each of the inner and outer mount plates 37 and 39 have formed thereon longitudinally spaced apertures 41 arranged in a pair of laterally spaced rows, FIG. 4. The corresponding apertures 41 of inner mount plate 37 are longitudinally staggered with respect to corresponding apertures 41 formed therethrough outer mount plate 39, as in FIG. 2.

A series of long nails 43, such as 16 penny nails, for illustration, project oppositely through the corresponding apertures 41 within the respective inner and outer mount plates and project into and substantially throughout the width of the corresponding studs 15.

The present security striker plate is particularly adapted for a new construction wherein before the application of dry walls 17 and 19, the present security striker plate 11 and its corresponding inner and outer mount plates 37, 39 are positioned snugly over the corresponding studs 15 and secured thereto by a series of oppositely directed fasteners or nails 43.

The inner mount plate 37 terminates in the right angularly related strike plate 45 which has an outwardly directed upright end flange 47 adapted for registry with dry wall 17. The apertured strike plate 45 upon one side terminates in the upright outwardly directed door engaging lip 49.

In the illustrative embodiment, an adjacent portion of door stop 35 forming a part of the door jamb 13 is cut away at 51, FIGS. 2 and 5, and cooperatively receives door stop lip 49 along its height. Accordingly, the door stop lip 49 registers with door stop 35 as a continuation thereof and is aligned with the door stop and is adapted to reinforce adjacent portions of the exterior door jamb 13.

Formed through strike plate 45 are a series of transverse apertures as for example, deadbolt opening 53 adapted to receive deadbolt 55, FIG. 2, sometimes referred to as an outside deadbolt, as in FIGS. 1 and 2. The deadbolt is a part of an outside deadbolt assembly 57 mounted upon door 31 which includes retractable deadbolt 55 which when advanced projects into strike plate aperture 53 of FIG. 5 for interlock therewith.

Deadbolt opening 59, FIG. 5, within strike plate 45 is adapted to receive deadbolt 61, sometimes referred to as an inside deadbolt, which forms a part of the inside deadbolt assembly 63 secured upon door 31, FIG. 1. The deadbolt 61 when advanced is adapted to lockingly project through corresponding aperture 59 in strike plate 45.

Additional aperture 65, preferably of rectangular shape, is referred to as a latch opening is formed within said strike plate and is adapted to receive the latch 67, FIG. 6, sometimes referred to as a latch bolt. The latch bolt forms a part of latch bolt assembly 69 of a standard lock within the knob secured upon door 31, FIG. 1.

Projecting from the other side of door stop lip 49 is an inset anchor plate 71 or spacer flange which is positioned rearwardly of strike plate 45 and extends along the interior surface of door jamb 13, FIG. 6, and connects with outer mount plate 39 as a part thereof.

Outer mount plate 39 outwardly of anchor plate 71 terminates in door jamb anchor flange 73 which extends into an undercut opening within door jamb 13, FIGS. 2 and 6, and is interlocked therewith.

The present improved security strike plate is particularly adapted for new building constructions before the dry walls 17 and 19 are applied. The security striker plate 11 is mounted upon and encloses portions of adjacent upright studs 15. Corresponding inner and outer mount flanges 37 and 39 snugly receive inner and outer upright edge portions of the corresponding studs and are secured thereto by a series of elongated fasteners, such as nails 43.

Nails 43 are oppositely directed, with the nails which extend through the inner mount plate 37 longitudinally staggered with respect to the nails 43 which project through corresponding apertures 41 in the outer mount plate 39 to avoid interference. This is because the corresponding nails 43 extend substantially the full width of the corresponding studs 15. As shown in FIGS. 2 and 6, the respective mount plates of the security striker plate overlie a pair of adjacent studs 15 and are respectively secured thereto in a substantially permanent manner.

This being a new construction with a layer of insulation 21 applied as in FIG. 2 or 6, thereafter the outer and inner dry walls 19 and 17 are applied in a conventional fashion with the outer dry wall 19 enclosing insulation 21, extending behind outer brick veneer 23 up to molding 27.

The inner dry wall 17 extends along the respective inner surfaces of the corresponding upright studs 15, overlies the corresponding mount flange 37 of the striker plate and extends to flange 47 of striker plate 45, FIGS. 2 and 6.

The present construction provides for the door stop lip 49 in such an arrangement as to prevent exterior access by an intruder to the deadbolts or latch bolt, such as shown at 55 and 67 or 61 upon the door 31, shown in FIG. 1 or FIGS. 2 and 6.

Conventionally, door jambs are relatively weak compared to joists or studs 15. In accordance with the present invention and particularly in new constructions, the present striker plate is adapted for mounting and anchoring to the interior upright studs 15, FIGS. 2, 5 and 6, and is suitably secured thereto by fasteners such as the oppositely directed series of nails 43 which project through corresponding apertures 41 in mount plates 37 and 39.

Having described my invention, reference should now be had to the following claims;

I claim:

1. A security striker plate for a locking means upon an exterior door hinged within a door jamb, including an upright rail, a peripheral door stop and interior upright framing studs, said security striker plate comprising:

said body including a pair of spaced opposed upright inner and outer mount plates of equal width and height adapted to be snugly positioned over and along opposite sides of the framing studs;

each of said mount plates having longitudinally spaced nail apertures therethrough arranged in a row adapted to receive nails for securing the mount plates to the studs;

an elongated apertured strike plate extending from and at a right angle to said inner mount plate and adapted to face the door when closed;

an elongated door stop lip having first and second portions, said first portion extending from and at a right angle to one side of said strike plate adapted to be inserted within and in registry with and reinforcing the door stop and door jamb;

an elongated anchor plate inset from and projecting from said door stop lip at right angles thereto and adapted for snug retaining registry with an interior portion of the door jamb and retained thereby, one end of said anchor plate extending to and connected with said outer mount plate;

the second portion of said door stop lip extending from the other side of said strike plate to said anchor plate;

a door jamb anchor flange projecting from said outer mount plate and said anchor plate parallel to said door stop lip and adapted for retained interlock with the overlying door jamb; and an upright end flange located upon and extending along said strike plate perpendicular to said inner mount plate;

said elongated strike plate, door stop lip, anchor plate, door jamb anchor flange and upright end flange being integral parts of said elongated unit body and having generally the same height as said inner and outer mount plates.

2. In the striker plate of claim 1, the apertures in one mount plate being longitudinally staggered with respect to the apertures in the other mount plate.

3. In the striker plate of claim 1, the apertures in each mount plate being arranged in a pair of laterally spaced rows.

4. In the striker plate of claim 1, said body being constructed of extruded aluminum.

5. In combination with a structure including a frame and an exterior door having locking means thereon, with the frame defining a door jamb including an upright rail, a peripheral door stop and a plurality of interior framing studs having adjacent side portions which are cut away to thereby define a stop socket, a security striker plate located within the upright rail, and a wall means on opposite sides of the studs, said security striker plate comprising:

an elongated unit body of general U-shape in cross section;

said body including a pair of spaced opposed upright inner and outer mount plates snugly positioned over and along opposite sides of the framing studs, with said inner mount plate received in and anchored by said stop socket, said outer mount plate abutting additional side portions of said studs which are parallel to the side portions defining the stop socket;

each of said mount plates having longitudinally spaced nail apertures therethrough arranged in a row;

a series of nails extending through the nail apertures of said inner and outer mount plates in opposite directions and anchoring said security striker plate to said framing studs;

said wall means covering the framing studs and the inner and outer mount plates thereby enclosing said nails and said mount plates;

said security striker plate further comprising an elongated apertured strike plate extending from and at a right angle to said inner mount plate and facing the door when closed;

said stop socket also spacing said strike plate away from the opposite stud to define a dead bolt and latch chamber;

an elongated door stop lip having first and second portions, said first portion extending from and at a right angle to one side of said strike plate inserted within, and registry with and reinforcing said door stop and door jamb;

An elongated anchor plate inset from and projecting from said door stop lip at right angles thereto in snug retaining registry with an interior portion of said door jamb and retained thereby, one end of said anchor plate extending to and connected with said outer mount plate;

the second portion of said door stop lip extending from the other side of said strike plate to said anchor plate;

a door jamb anchor flange projecting from said outer mount plate and outwardly of said anchor plate for retained interlock with the overlying door jamb; and an upright end flange located upon and extending along said strike plate perpendicular to said inner mount plate and abutting the wall means engaging said inner mount plate.

6. In the combination of claim 5, the apertures in one mount plate being longitudinally staggered with respect to the apertures in the other mount plate.

7. In the combination of claim 5, the apertures in each mount plate being arranged in a pair of laterally spaced rows.

8. In combination of claim 5, said locking means including a dead bolt lock assembly mounted upon said door adjacent said rail, including a dead bolt when advanced, projecting through an aperture in said strike plate and interlocked therewith, said door stop lip protecting said dead bolt from tampering.

9. In combination of claim 5, said locking means including a latch bolt assembly mounted upon said door adjacent said rail, including a latch bolt when advanced, projecting through an aperture in said strike plate and interlocked therewith, said door stop lip protecting said latch bolt from tampering.

10. In combination of claim 5, said locking means including a dead bolt assembly and a latch bolt assembly mounted upon said door adjacent said rail, the dead bolt assembly including a dead bolt when advanced, projecting through an aperture in said strike plate;

said latch bolt assembly including a latch bolt when advanced, projecting through a corresponding aperture in said strike plate, said door stop lip protecting said dead bolt and said latch bolt from tampering.

* * * * *

UNITED STATES PATENT AND TRADEMARK OFFICE

CERTIFICATE OF CORRECTION

PATENT NO. : 4,717,185

DATED : January 5, 1988

INVENTOR(S) : Richard A. Hartley

It is certified that error appears in the above-identified patent and that said Letters Patent is hereby corrected as shown below:

Column 5, claim 1, after line 39 and before line 40 "said body including . . ." insert as a separate paragraph --an elongated unit body of general U-shape in cross section;--

Signed and Sealed this

Second Day of August, 1988

*Attest:*

*Attesting Officer*

DONALD J. QUIGG

*Commissioner of Patents and Trademarks*